US007607643B1

(12) United States Patent
Box et al.

(10) Patent No.: US 7,607,643 B1
(45) Date of Patent: Oct. 27, 2009

(54) FAIRLEAD

(75) Inventors: Gary Box, Centreville, MS (US); Jon Craft, Denham Springs, LA (US)

(73) Assignee: Anvil Attachments, Slaughter, LA (US)

( * ) Notice: Subject to any disclaimer, the term of this patent is extended or adjusted under 35 U.S.C. 154(b) by 0 days.

(21) Appl. No.: 12/006,500

(22) Filed: Jan. 3, 2008

(51) Int. Cl.
*B66D 1/36* (2006.01)

(52) U.S. Cl. ..... 254/338; 254/383; 254/393; 254/395; 254/323; 294/82.11

(58) Field of Classification Search ..... 254/285, 254/287, 378, 383, 393, 394, 395; 37/396; 294/82.11
See application file for complete search history.

(56) References Cited

U.S. PATENT DOCUMENTS

| | | | | | |
|---|---|---|---|---|---|
| 16,992 | A | * | 4/1857 | Osgood | 254/395 |
| 458,855 | A | * | 9/1891 | Meinzer | 254/395 |
| 1,887,306 | A | * | 11/1932 | Huff | 254/395 |
| 2,043,362 | A | | 6/1936 | Wilson | |
| 2,106,000 | A | * | 1/1938 | George | 254/395 |
| 2,483,760 | A | * | 10/1949 | Duncan | 254/395 |
| 3,655,081 | A | | 4/1972 | Monk | |
| 3,739,928 | A | | 6/1973 | Randall | |
| 3,747,402 | A | | 7/1973 | Branham | |
| 3,748,711 | A | | 7/1973 | Smith | |
| 3,830,507 | A | | 8/1974 | Johnson | |
| 3,934,917 | A | | 1/1976 | Paxton et al. | |
| 3,943,875 | A | | 3/1976 | Sanders | |
| 3,956,835 | A | | 5/1976 | Evenson | |
| 3,975,044 | A | | 8/1976 | Briggs | |
| 3,984,085 | A | | 10/1976 | Bexten | |
| 3,987,526 | A | | 10/1976 | Poplawski | |
| 3,994,477 | A | | 11/1976 | Bexten | |
| 4,080,919 | A | | 3/1978 | Holland et al. | |
| 4,174,131 | A | | 11/1979 | Gregg | |
| 4,246,675 | A | * | 1/1981 | Costanzo | 15/315 |
| 4,260,119 | A | | 4/1981 | Price | |
| 4,324,525 | A | | 4/1982 | Lane | |
| 4,327,897 | A | * | 5/1982 | Smith | 254/395 |
| 4,390,162 | A | | 6/1983 | Woolslayer | |
| 4,392,774 | A | | 7/1983 | Thomas, Jr. | |
| 4,601,506 | A | | 7/1986 | Hilson | |
| 4,662,525 | A | | 5/1987 | Bottem | |
| 4,742,993 | A | | 5/1988 | Montgomery et al. | |
| 4,795,135 | A | | 1/1989 | Scott | |
| 4,796,863 | A | | 1/1989 | Reed | |
| 4,807,918 | A | | 2/1989 | Weeks | |
| 4,836,300 | A | | 6/1989 | Reed | |
| 4,903,443 | A | | 2/1990 | Reed | |
| 4,975,017 | A | | 12/1990 | Brigden | |
| 4,991,323 | A | | 2/1991 | Benkler | |
| 5,141,386 | A | | 8/1992 | Barwise | |
| 5,375,896 | A | | 12/1994 | Zimmer | |
| 5,443,294 | A | | 8/1995 | Prinz et al. | |

(Continued)

OTHER PUBLICATIONS

International Search Report in PCT/US09/30035; dated Feb. 17, 2009.

*Primary Examiner*—Emmanuel M Marcelo
(74) *Attorney, Agent, or Firm*—Dickinson Wright, PLLC

(57) ABSTRACT

An improved fairlead for efficiently guiding a cable as it is wound on to or off of a drum. The improved fairlead reduces operation and labor concerns by decreasing cable wear and increasing cable life.

9 Claims, 3 Drawing Sheets

U.S. PATENT DOCUMENTS

| | | | | |
|---|---|---|---|---|
| 5,471,772 | A | 12/1995 | Blaszynski et al. | |
| 5,533,769 | A | 7/1996 | Masamitsu | |
| 5,620,222 | A | 4/1997 | Prinz | |
| 5,740,582 | A | 4/1998 | Harrelson et al. | |
| 5,775,867 | A | 7/1998 | Christenson | |
| 6,358,073 | B1 | 3/2002 | Jhanson et al. | |
| 6,401,370 | B1 | 6/2002 | Blom et al. | |
| 6,729,606 | B1 * | 5/2004 | Durin | 254/395 |
| 2005/0116079 | A1 | 6/2005 | Stevens | |
| 2005/0279977 | A1 | 12/2005 | Kerry | |

* cited by examiner

FAIRLEAD

BACKGROUND OF THE INVENTION

1. Field of the Invention

This invention relates to cable guiding mechanisms in general, and more particularly, to a fairlead for guiding a cable as it is wound on to or off of a drum and into an excavating or material handling tool such as a clamshell bucket or grapple.

2. Prior Art

Companies currently spend hundreds to thousands of dollars on cables that are utilized in construction and mining operations. These cables are significant assets for such companies, and accordingly various mechanisms and devices are currently employed to maintain the integrity of the cables. As an example, fairlead mechanisms are often utilized in mining and construction operations to guide cables and to reduce cable wear and increase cable life. Although such fairleads are commonly known and utilized in the prior art, they often present major disadvantages. For example, many such fairleads are heavy, complex structures, containing numerous elements, making their utilization difficult for the user. Such fairleads also have increased manufacturing costs due to their complexity. Furthermore, many prior art fairleads are inefficient as they do not prevent undesirable contact of the cable with the ground or with the fairlead components. For example, in one type of fairlead that is commonly utilized, a cluster of adjacent rollers form a boundary to define an aperture via which the cable passes. In this type of mechanism, the boundary defining the aperture is neither smooth, circular, nor continuous. In such prior art fairleads, as the cable passes through the aperture, the outer diameter of the cable is subject to flattening, and the wear and tear on the cable is actually increased. As a result, companies utilizing these type of inefficient fairleads are required to continuously monitor, maintain, and repair these cables, increasing operation and labor costs. Furthermore, as such inefficient fairleads actually decrease the life span of the cables, companies are required to purchase and install new cables more frequently to replace them. Therefore, an improved fairlead meeting the following objectives would be highly desirable in the industry.

OBJECTS OF THE INVENTION

It is an object of the invention to provide an improved fairlead that overcomes the disadvantages of prior art fairleads.

It is an object of the invention to provide an improved and efficient fairlead that maintains the integrity of the cable.

It is an object of the invention to provide an improved fairlead that reduces operation and labor cost concerns by decreasing cable wear and increasing cable life.

It is an object of the invention to provide an improved and simplified fairlead capable of being manufactured at a reduced cost.

Other objects and advantages of this invention shall become apparent from the ensuing description of the invention.

SUMMARY OF THE INVENTION

An improved fairlead for guiding a cable is disclosed. The fairlead comprises a frame; a plurality of rollers rotatably mounted on the frame; each roller having an axis of rotation; each roller further having at least one face that is substantially parallel to the axis of rotation, wherein this face is substantially concave; and wherein the rollers are positioned adjacent to each other to form a substantially circular, corner-free aperture, for the passage of the cable.

BRIEF DESCRIPTIONS OF THE DRAWINGS

DESCRIPTION OF THE PREFERRED EMBODIMENTS OF THIS INVENTION

An improved fairlead for guiding a cable as it is wound onto or off of a drum is disclosed. Although the fairlead of the present invention has been described in connection with the operation of a crane, it is to be understood that the fairlead can also be utilized in other suitable applications in which a cable is used for hoisting or mining operations. Without attempting to limit the scope of the invention, the preferred embodiments of the invention are described with reference to FIGS. 1-4.

Figure 1:
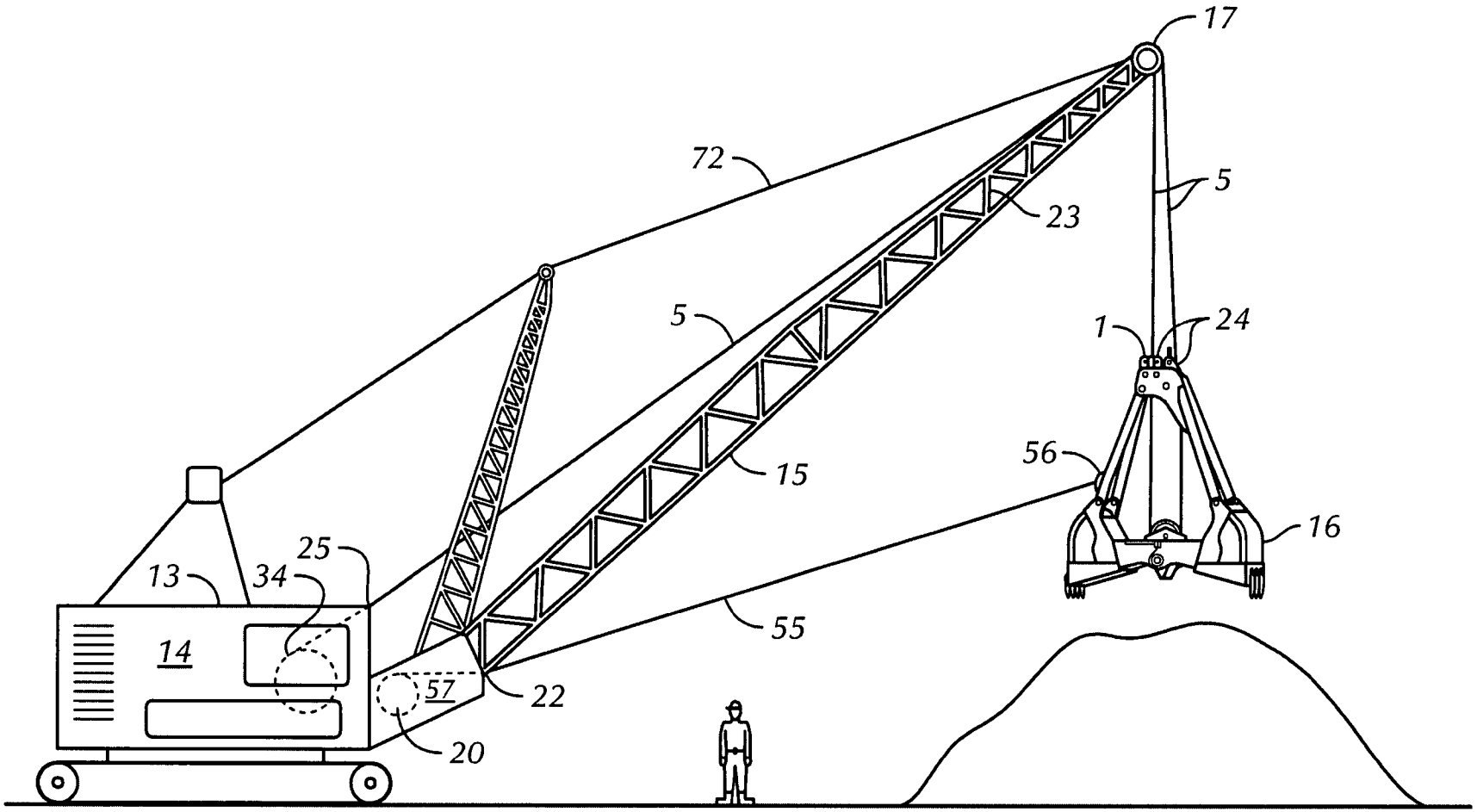
FIG. 1 is a perspective view of a preferred embodiment of a crane employing the improved fairlead of the present invention.

Fairlead 1 is described in connection with a conventional crane 13, i.e. a power-driven equipment with an excavating or material handling tool to excavate or move sand, gravel, mud, or other materials. See FIG. 1. Crane 13 will comprise the conventional elements generally known in the art, therefore only a brief discussion of the basic components of crane 13 will be provided. As depicted by FIG. 1, crane 13 comprises main housing 14 and a boom 15 attached to a lower end 22 of housing 14 and extending forwardly from housing 14, the boom 15 further being supported by a cable 72. A pulley 17 is rotatably mounted to an upper end 23 of boom 15, with holding and closing line cables 5 being reeved over pulley 17. An excavating or material handling tool, such as a clamshell bucket 16, is suspended from one end 24 of cables 5. The other end 25 of cables 5 is wound about a hoist drum 34 situated on main housing 14 and actuated by an operator in the known manner, to permit the operator to raise or lower bucket 16 or open or close bucket 16 by raising or lowering cables 5. Crane 13 further comprises one or more tagline cables 55. Tagline cable 55 is attached to bucket 16 at one end 56 via a tagline bracket, and on the other end 57, is wound about a tagline drum 20 situated on main housing 14. Drum 20 is controlled by operator in the known matter, to allow the operator to control the rotational swing of clamshell bucket 16.

Figure 2:
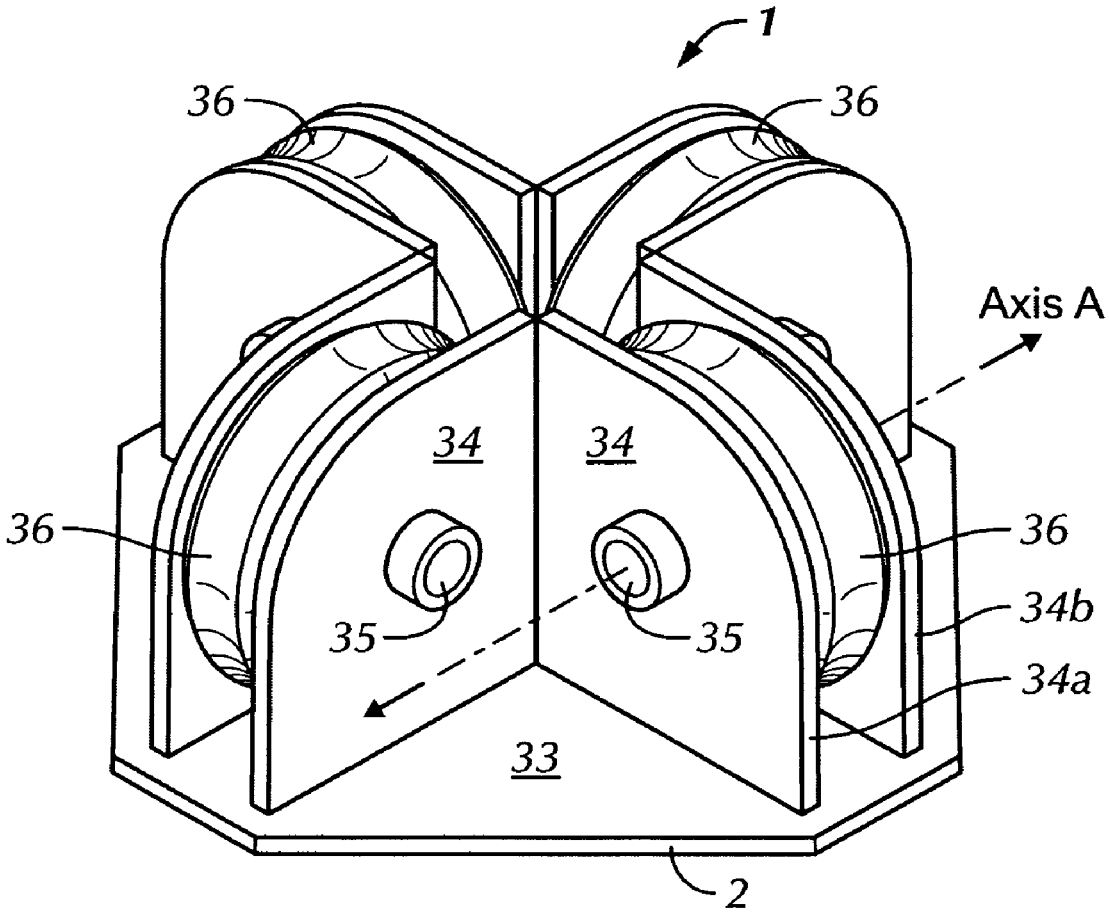
FIG. 2 is a perspective view of a preferred embodiment of the improved fairlead of the present invention.
Figure 3:
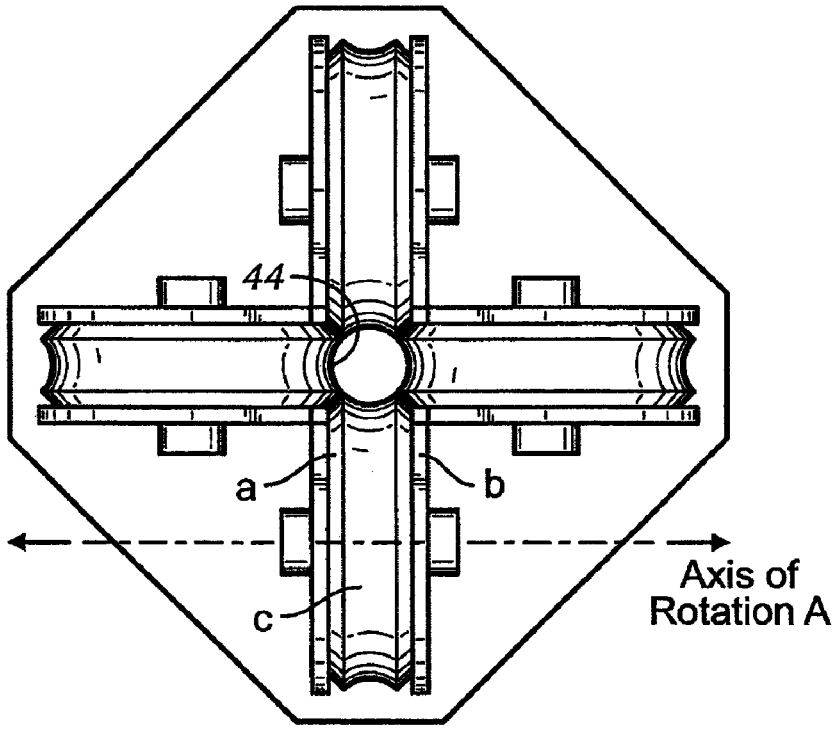
FIG. 3 is a top view of a preferred embodiment of the improved fairlead of the present invention.
Figure 4:
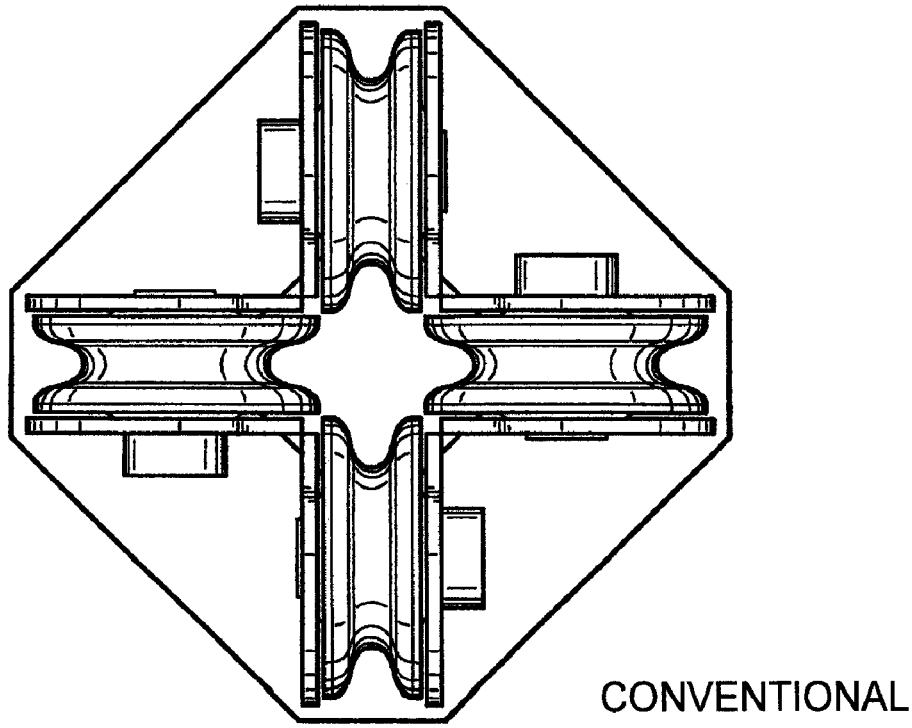
FIG. 4 depicts a prior art fairlead.

Referring now to FIG. 2, a preferred embodiment of the fairlead 1 of the present invention is illustrated. In a preferred embodiment, fairlead 1 comprises a frame 2 that is mounted on boom 15, however frame 2 can also be mounted on main housing 14 of crane 13, forward of hoist drum 34. Alternatively, fairlead 1 may also be mounted on top of clamshell bucket 16, as depicted in FIG. 1. Fairlead 1 may be permanently affixed to main housing 14, boom 15, or clamshell bucket 16, by welding or other such means; however, fairlead 1 is preferably a detachable piece that can be readily secured when and where desired. In a preferred embodiment, frame 2 further comprises a platform 33 upon which are mounted a plurality of brackets 34, preferably situated at right angles to each other. As depicted by FIG. 2, each bracket 34 comprises a first plate 34*a* and a second plate 34*b*. A roller 36 is transversely mounted between plates 34*a* and 34*b* of each bracket 34 via axle 35, such that each roller 36 is capable of rotation about a generally horizontal axis A. In a preferred embodiment, and as depicted by FIG. 3, each roller 36 further comprises a first face a, a second face b, and a third face c, with faces a and b being substantially perpendicular to the axis of rotation A, and with face c being substantially parallel to the axis of rotation A. In a further preferred embodiment, face c is substantially concave, preferably comprising an arc of approximately 90 degrees. In a further preferred embodiment, fairlead 1 comprises a first, second, third, and fourth roller 36 positioned adjacent to each other, more preferably positioned at 90 degree right angles to each other, to form a continuous, substantially circular, corner-free aperture 44 for holding and closing line cables 5 to pass through. See, FIG. 3. It will be appreciated that the aforementioned relationships of the elements to one another may deviate somewhat, provided that the end result achieved is a continuous, substantially circular, corner-free aperture 44.

In operation, crane 13 is first situated in the desired area to be excavated. Fairlead 1 is then mounted on top of clamshell bucket 16. The operator then selectively actuates hoist drum 34 to either raise or lower, or open or close, bucket 16 via holding and closing line cables 5. The operator can also selectively actuate tagline drum 20 to help control the rotation and position of clamshell bucket 16. In this fashion, clamshell bucket 16 can be situated in the desired working position to perform loading and unloading operations.

The aforementioned vertical up and down movement of bucket 16, accompanied by the bucket's own horizontal swaying motion, exert directional forces upon holding and closing line cable 5. Fairlead 1 minimizes the unwanted effects of all these forces on holding and closing line cables 5 by guiding the movement of cables 5, and by cradling the outer diameter of cables 5 in order to maintain the circular integrity of same. As drum 34 is actuated, cables 5 will pass between rollers 36 of fairlead 1 via aperture 44. Rollers 36 will rotate along generally horizontal axis A in response to the movement of cables 5 to control the movement of cables 5 and to help maintain cables 5 in proper alignment. Furthermore, as fairlead 1 is constructed and designed to form a continuous, substantially circular, corner-free aperture 44, cables 5 will not experience any tangential surface contact flattening, or wear and tear, of their outer diameters, as often experienced in prior art fairleads, such as the one depicted by FIG. 4.

In summary, the invention provides an improved fairlead 1 for guiding a cable as it is wound onto or off of a drum, without compromising the integrity of the cable. This in turn prolongs the life span of the cable, and increases the efficiency of operation. In addition, the simplified construction of fairlead 1 makes it capable of being manufactured at reduced cost.

While the invention has been described in terms of its preferred embodiment, other embodiments will be apparent to those of skill in the art from a review of the foregoing. Those embodiments as well as the preferred embodiments are intended to be encompassed by the scope and spirit of the following claims.

We claim:

1. An apparatus comprising:

a. a housing;

b. a drum mounted on the housing;

c. a cable wound around the drum, whereby when the drum is actuated, the cable can be wound onto or wound off of the drum;

d. a tool positioned forward of the drum, the tool being operable via the cable; and e. a fairlead positioned on the tool for guiding the cable when the cable is wound onto or wound off of the drum, wherein the fairlead comprises a frame and a plurality of rollers rotatably mounted on the frame, wherein each roller has an axis of rotation and at least one substantially concave face that is substantially parallel to the axis of rotation, and wherein the rollers are positioned adjacent to each other to form a substantially circular, corner-free aperture for the passage of the cable.

2. The apparatus according to claim 1, wherein the plurality of rollers comprises at least four rollers.

3. The apparatus according to claim 1, wherein the frame comprises a platform having a plurality of brackets mounted thereupon.

4. The apparatus according to claim 1, wherein one of the plurality of rollers is transversely mounted between each bracket.

5. The apparatus according to claim 1, wherein the axis of rotation is generally horizontal.

6. The apparatus of claim 1, wherein each roller further comprises two faces that are substantially perpendicular to the axis of rotation.

7. The apparatus according to claim 1, wherein the rollers are positioned at approximately right angles to each other.

8. The apparatus according to claim 1, wherein the substantially concave face comprises an arc of approximately 90 degrees.

9. An excavating or material handling machine comprising:

a. a housing;

b. a drum mounted on the housing;

c. a boom extending from the housing;

d. an excavating or material handling tool suspended from the boom;

e. a cable wound around the drum, whereby when the drum is actuated, the cable can be wound onto or wound off of the drum to move the excavating tool toward and away from the housing; and f. a guide assembly mounted on the excavating or material handling tool for guiding the cable when the cable is wound onto or wound off of the drum, wherein the guide assembly comprises a frame and plurality of rollers rotatably mounted in the frame, each of the rollers has an axis of rotation and at least one face that is substantially parallel to the axis of rotation, the at least one face is substantially concave, and the rollers are positioned adjacent to each other to form a substantially circular, corner-free aperture, for the passage of the cable.

* * * * *